US005128826A

United States Patent [19]

Yoneshige

[11] Patent Number: 5,128,826

[45] Date of Patent: Jul. 7, 1992

[54] D.C. SOLENOID

[75] Inventor: Kazuhiro Yoneshige, Nagoya, Japan

[73] Assignee: Aisan Kogyo Kabushiki Kaisha, Ohbu, Japan

[21] Appl. No.: 450,076

[22] Filed: Dec. 13, 1989

[30] Foreign Application Priority Data

Jan. 27, 1989 [JP] Japan ..... 1-8668

[51] Int. Cl.[5] ..... H01F 7/13

[52] U.S. Cl. ..... 361/165; 361/210; 361/154; 251/129.09

[58] Field of Search ..... 361/24, 27, 140, 154, 361/160, 161, 165, 194, 205, 210, 106, 58; 335/179; 137/156; 123/461; 251/129.02, 129.09, 129.1

[56] References Cited

U.S. PATENT DOCUMENTS 1,325,048 12/1919 Simon ..... 361/154
3,159,768 12/1964 Flanagan ..... 361/106
3,387,188 6/1968 Euler ..... 361/156
4,032,823 6/1977 Arvisenet et al. ..... 361/194

FOREIGN PATENT DOCUMENTS 59-107108 7/1984 Japan .

*Primary Examiner*—Howard L. Williams
*Assistant Examiner*—David Osborn
*Attorney, Agent, or Firm*—Cushman, Darby & Cushman

[57] ABSTRACT

In a d.c. solenoid in which a thermistor having a positive temperature coefficient is connected in series with a main coil, a subcoil is connected in parallel with the series connection of the main coil and the thermistor, so that a large magnetic force can be produced at the solenoid energization starting time, and generation of heat from the thermistor can be suppressed to prevent burnout of the main coil due to continuous current supply. Both the main coil and the subcoil, when energized alone, are capable of actuating the solenoid. The d.c. solenoid is applied to a valve in a vaporized fuel absorption system.

6 Claims, 2 Drawing Sheets

D.C. SOLENOID

BACKGROUND OF THE INVENTION

This invention relates to a d.c. solenoid, and more particularly to a d.c. solenoid which can reliably operate.

One form of a prior art d.c. solenoid is disclosed in JP-A-59-107108. As shown in FIG. 1, the prior art d.c. solenoid comprises a main coil 1 for attracting a plunger, a thermistor 2 connected in series with the main coil 1 for preventing burn-out of the main coil 1, and a main switch 3 through which the series connection of the main coil 1 and the thermistor 2 is disconnectably connected to a d.c. power source 4.

The thermistor 2 has a positive temperature coefficient as shown in FIG. 2. It will be seen in FIG. 2 that, in a temperature range higher than a predetermined temperature, the resistance value of the thermistor 2 sharply increases with the increase in the temperature. Thus, although a large current is supplied to the main coil 1 when the solenoid starts to be energized at time To in FIG. 3, the current supplied to the main coil 1 sharply decreases with lapse of time as shown in FIG. 3. This is because the temperature of the thermistor 2 sharply rises as a result of self-heating and due to the ambient temperature, and its resistance value shows a great increase.

Therefore, when the diameter, number of turns and other factors of copper wire forming the main coil 1 and the operating characteristic of the thermistor 2 are suitably selected, a large magnetic force can be produced at the solenoid energization starting time, and, after energization of the solenoid, generation of heat from the main coil 1 can be suppressed, thereby preventing undesirable burn-out of the main coil 1 and producing the required plunger holding force.

However, in the prior art d.c. solenoid described above, the temperature of the thermistor 2 heated up to a high temperature level by the current supplied from the d.c. power source 4 would not be immediately lowered even when the main switch 3 is turned off. Thus, when the solenoid is re-energized at time $T_1$ in FIG. 3, the resistance value of the thermistor 2 remains large even at that time, and a minimum energizing current Ao, shown in FIG. 3, required for re-energization of the solenoid may not be supplied to the main coil 1, resulting in inability to re-energize the solenoid.

SUMMARY OF THE INVENTION

With a view to obviate such drawback of the prior art d.c. solenoid, it is an object of the present invention to provide an improved d.c. solenoid which can be reliably re-energized without waiting for cooling of the thermistor.

In accordance with the present invention which attains the above object, there is provided a d.c. solenoid comprising a main coil, a thermistor having a positive temperature coefficient, the thermistor being connected in series with the main coil, and a subcoil connected in parallel with the series connection of the main coil and the thermistor.

In the d.c. solenoid of the present invention having the structure described above, a large current is supplied to the main coil at the solenoid energization starting time because the temperature of the thermistor is low, and its resistance value is small as in the case of the prior art d.c. solenoid. With lapse of time, the current supplied to the main coil decreases because the temperature of the thermistor rises to increase its resistance value, as also described with reference to FIGS. 1 to 3.

On the other hand, although the temperature of the thermistor is still high at the time of re-energization of the solenoid, and any substantial current is not supplied to the main coil at that time, the minimum energizing current required for re-energization of the solenoid can be supplied to the subcoil thereby producing a large magnetic force because the subcoil is connected in parallel with the series connection of the main coil and the thermistor.

Therefore, according to the present invention, the required large magnetic force can be produced at the time of re-energization of the solenoid, and generation of heat from the main coil can be suppressed to prevent objectionable burn-out of the main coil even when the current is continuously supplied to the main coil. Also, the solenoid can be reliably re-energized without waiting for cooling of the thermistor.

DESCRIPTION OF THE PREFERRED EMBODIMENTS

Preferred embodiments of the present invention will now be described with reference to FIGS. 4, 5 and 6.

Figure 1:
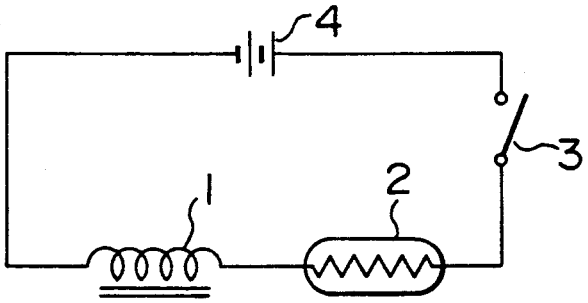
FIG. 1 PRIOR ART
FIG. 1 is a circuit diagram showing the structure of a prior art d.c. solenoid.
Figure 2:
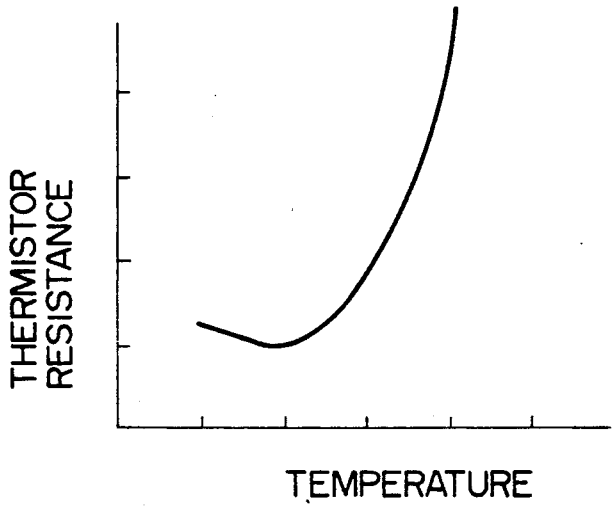
FIG. 2 PRIOR ART
FIG. 2 is a graph showing the temperature-resistance characteristic of the thermistor used in the d.c. solenoid shown in FIG. 1.
Figure 3:
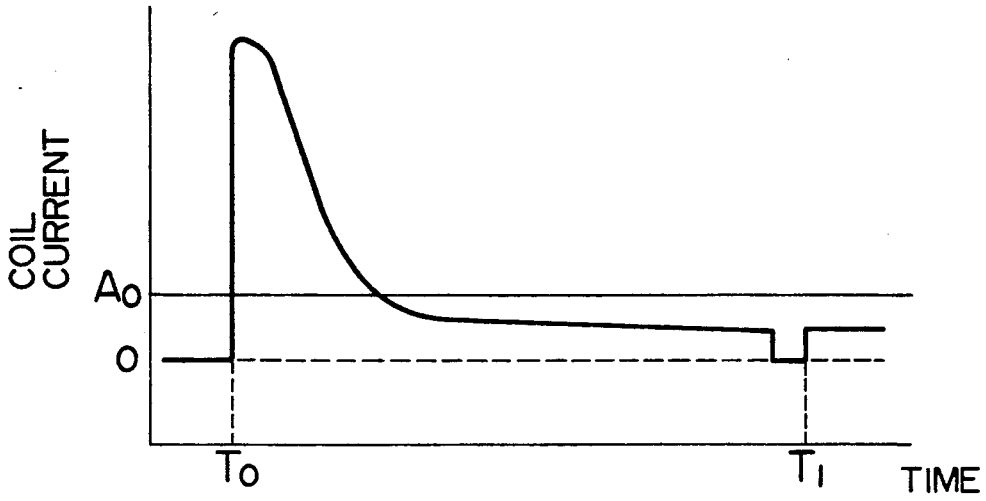
FIG. 3 PRIOR ART
FIG. 3 is a graph showing the operating characteristic of the d.c. solenoid shown in FIG. 1.
Figure 4:
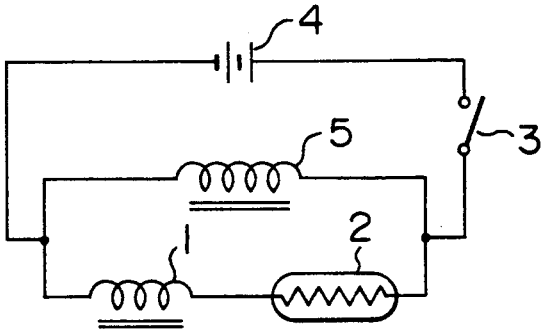
FIG. 4 is a circuit diagram showing the structure of a preferred embodiment of the improved d.c. solenoid according to the present invention.

FIG. 4 is a circuit diagram showing the structure of a preferred embodiment of the improved d.c. solenoid according to the present invention. Referring to FIG. 1, the improved d.c. solenoid embodying the present invention comprises, in addition to the series connection of the main coil 1 and the thermistor 2 having the positive temperature coefficient, a subcoil 5 connected in parallel with the series connection of the main coil 1 and the thermistor 2.

Figure 5:
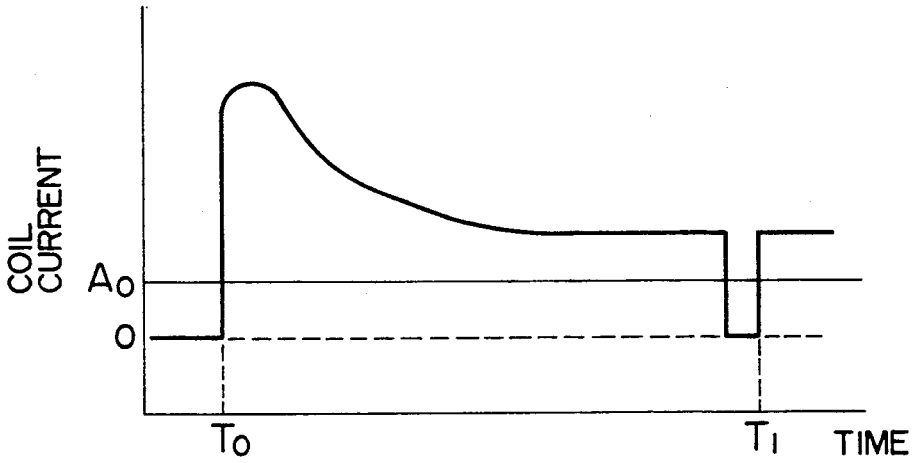
FIG. 5 is a graph showing how the coil current in the d.c. solenoid shown in FIG. 4 changes with time.

In the d.c. solenoid having such a structure, the temperature of the thermistor 2 is low, and its resistance value is very small at the solenoid energization starting time $T_0$ in FIG. 5, so that a large current is supplied to the main coil 1 at that time as shown in FIG. 5. With lapse of time, the resistance value of the thermistor 2 sharply increases due to the temperature rise of the thermistor 2 itself, with the result that the current supplied to the main coil 1 sharply decreases.

On the other hand, although the temperature of the thermistor 2 is still high at the time of re-energization of the solenoid (time $T_1$ in FIG. 5), and substantial current is not supplied to the main coil 1 at that time, the minimum energizing current Ao required for re-energization of the solenoid can be supplied to the subcoil 5 thereby producing a large magnetic force, because the subcoil 5 is connected in parallel with the series connection of the main coil 1 and the solenoid 2.

Therefore, when the diameters, numbers of turns and other factors of copper wire forming the main coil 1 and subcoil 5 and the operating characteristic of the thermistor 2 are suitably selected, a great magnetic force can be produced at the solenoid energization starting time, and generation of heat from the main coil 1 can be minimized thereby preventing objectionable burn-out of the main coil 1. Also, re-energization of the solenoid can be reliably started without waiting for cooling of the thermistor 2.

Figure 6:
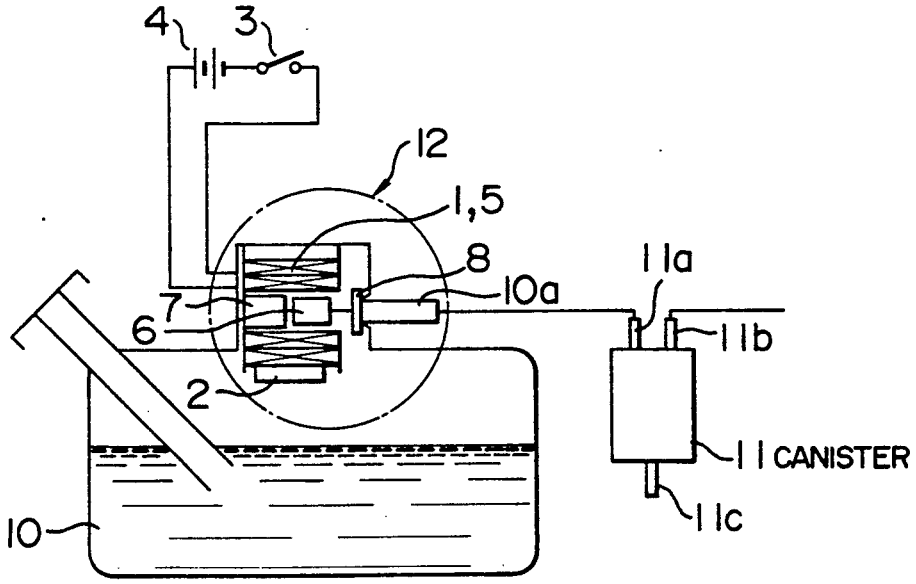
FIG. 6 schematically shows the structure of a vaporized fuel adsorption purpose canister system provided with a solenoid operated valve to which the d.c. solenoid of the present invention is applied.

FIG. 6 shows an example of application of the d.c. solenoid embodying the present invention to a vaporized fuel adsorption purpose canister system mounted on a vehicle.

Referring to FIG. 6, the canister system includes a canister 11 connected to a fuel tank 10 and an electromagnetic or solenoid operated valve 12 for controlling opening and closing of a delivery port 10*a* of the fuel tank 10 connected to a suction port 11*a* of the canister 11. This solenoid operated valve 12 is turned on-off by the combination of a fuel supply switch (not shown) and the main switch 3 connected for interlocking operation. At the time of fuel supply, the delivery port 10*a* of the fuel tank 10 is opened by the solenoid operated valve 12, and fuel vaporized in the fuel tank 10 is fed through the suction port 11*a* into the canister 11. The interior of the canister 11 is filled with a layer of an adsorbent such as active carbon which adsorbs to collect harmful matter contained in the vaporized fuel. When a negative pressure or vacuum induced in the intake manifold of the engine under operation is introduced through a purge port 11*b* of the canister 11 and acts upon the layer of the adsorbent filled in the canister 11, the farmful matter absorbed and collected in the adsorbent layer is desorbed from the absorbent layer by fresh air introduced through an atmospheric communication port 11*c* into the canister 11. Thus, the vaporized fuel, from which the harmful matter is completely removed, is supplied through the purge port 11*b* of the canister 11 into the intake manifold to be burnt in the cylinders of the engine.

The d.c. solenoid shown in FIG. 4 is applied to the solenoid operated valve 12 shown in FIG. 6. In addition to the main coil 1, the thermistor 2, the main switch 3, the d.c. power source 4 which is the vehicle's battery in this case, and the subcoil 5, the solenoid operated valve 12 includes a plunger 6 attracted by the combination of the main coil 1 and the subcoil 5, a core 7 magnetically coupled to the plunger 6, and a valve member 8 adapted to reciprocate in unitary relation with the plunger 6 to open and close the delivery port 10*a* of the fuel tank 10.

In the canister system shown in FIG. 6, the internal pressure of the fuel tank 10 becomes considerably high, because the fuel tank 10 is heated by the ambient temperature and also by the heat generated from the engine and also because vibration is imparted thereto while the vehicle is running. Thus, a large force is required so as to urge the valve member 8 in the opening direction at the time of fuel supply. However, in the case of the solenoid operated valve 12 to which the d.c. solenoid embodying the present invention is applied, a large attraction force can be produced as soon as the solenoid is energized, so that the valve member 8 can be reliably urged in the opening direction against the internal pressure.

Also, because the force required to maintain the valve member 8 in the open position is smaller than the attraction force required for urging the valve member 8 in the opening direction, the valve member 8 can be stably maintained in the open position even when the current supplied to the main coil 1 decreases as a result of the temperature rise of the thermistor 2 during the period of supply of the fuel to the engine.

Also, once the delivery port 10*a* of the fuel tank 10 is opened, the internal pressure of the fuel tank 10 is lowered. Therefore, even when the temperature of the thermistor itself 2 is still high at the time of re-energization of the solenoid for the purpose of, for example, immediate additional fuel supply, and a large attraction force may not be produced, the subcoil 5 can produce the attraction force enough to attract the plunger 6 thereby urging the valve member 8 in the opening direction.

It will be understood from the foregoing description that the d.c. solenoid embodying the present invention can produce a large magnetic force in spite of its simple structure as soon as it is energized and can be reliably re-energized without waiting for cooling of the thermistor. Therefore, the d.c. solenoid of the present invention can be especially usefully applied to a solenoid operated valve incorporated in a canister system for controlling opening and closing of a delivery port of a fuel tank for supplying fuel to an engine of a vehicle.

I claim:

1. A d.c. solenoid control circuit comprising:

a main coil capable of actuating the solenoid alone, a thermistor having a positive temperature coefficient, said thermistor being connected in series with said main coil such that heating of said thermistor causes increased resistance in series with said main coil, and a subcoil also capable of actuating the solenoid alone, connected in parallel with the series connection of said main coil and said thermistor.

2. A vaporized fuel absorption purpose canister system that includes a fuel tank and a canister, said system comprising a solenoid operated valve between the fuel tank and canister using a d.c. solenoid comprising the main coil capable of actuating said d.c. solenoid alone, a thermistor having a positive temperature coefficient, said thermistor being connected in series with said main coil such that heating of said thermistor causes increased resistance in series with said main coil and a subcoil, also capable of actuating the solenoid alone, connected in parallel with the series connection of said main coil and said thermistor.

3. A d.c. solenoid assembly comprising:

a solenoid having a main coil and a subcoil, either of which, when energized alone, will actuate said solenoid;

a thermistor having a positive temperature coefficient, said thermistor being connected in series with said main coil such that heating of said thermistor causes increased resistance in series with said main coil, wherein said subcoil is connected in parallel with the series connection of said main coil and said thermistor so that said subcoil is not affected by resistance change of said thermistor.

4. An assembly as in claim 3 further comprising a switch and a power source which is switchably connectable across a parallel combination of said subcoil and main coil/thermistor by operation of said switch, so that when said power supply is energized and said switch is closed; said parallel combination receives energy thereacross.

5. A fuel passage opening system adapted for connecting a fuel tank to a fuel destination comprising:

a fuel passage, connected between the fuel tank and the fuel destination a solenoid operated valve, using a d.c. solenoid that has a main coil and a subcoil, either of which, when energized, will actuate said solenoid a thermistor having a positive temperature coefficient, said thermistor being connected in series with said main coil such that heating of said thermistor causes increased resistance in series with said main coil, wherein said subcoil is connected in parallel with the series connection of said main coil and said thermistor so that an initial actuating of the solenoid when said thermistor is cold causes a large amount of magnetic attraction within said solenoid, sufficient to overcome pressure in said fuel tank, but another actuating of said solenoid while said thermistor is still warm causes less magnetic attraction, but enough magnetic attraction to actuate the valve, since said pressure in said fuel tank will not yet have reestablished.

6. An assembly as in claim 5 further comprising a switch and a power source which is switchably connectable across a parallel combination of said subcoil and main coil/thermistor by operation of said switch, so that when said power supply is energized and said switch is closed, said parallel combination receives energy thereacross.

* * * * *